United States Patent [19]

Lutz et al.

[11] Patent Number: 4,617,542

[45] Date of Patent: Oct. 14, 1986

[54] HIGH VOLTAGE SWITCHING DEVICE

[75] Inventors: Erno B. Lutz, Sunnyvale; Bruce A. Weber, San Jose; Jerry Markle, Mountain View, all of Calif.

[73] Assignee: IMCS Corporation, Mountain View, Calif.

[21] Appl. No.: 637,030

[22] Filed: Aug. 2, 1984

Related U.S. Application Data

[63] Continuation-in-part of Ser. No. 542,583, Oct. 17, 1983.

[51] Int. Cl.[4] ..... H01H 1/00

[52] U.S. Cl. ..... 335/196; 200/150 A; 335/47

[58] Field of Search ..... 200/150 A; 335/58, 47, 335/276, 196

[56] References Cited

U.S. PATENT DOCUMENTS 2,850,593 9/1958 Hoover et al. ..... 200/150 A
3,114,811 12/1963 Kohman ..... 335/58

FOREIGN PATENT DOCUMENTS 382193 10/1932 United Kingdom ..... 200/150 A

*Primary Examiner*—Harold Broome
*Attorney, Agent, or Firm*—Thomas E. Schatzel

[57] ABSTRACT

A switch having gold-plated contacts on which is formed a gold-mercury amalgam, at least the contacts being immersed in a totally fluorinated hydrocarbon fluid.

10 Claims, 4 Drawing Figures

HIGH VOLTAGE SWITCHING DEVICE

CROSS REFERENCE TO THE RELATED APPLICATION

The present application is a continuation in part of the U.S. patent application Ser. No. 06/542,583 which was filed on Oct. 17, 1983.

BACKGROUND OF THE INVENTION

1. Field of the Invention

The present invention relates to switches generally and more specifically to a magnetically actuated switch (relay) having mercury-wetted, gold-plated contacts that are immersed in a totally fluorinated hydrocarbon.

2. Description of the Prior Art

Many semiconductor-type devices are susceptible to being damaged when subjected to electrostatic discharges of the type which commonly occur when devices are touched. To provide meaningful information as to the susceptability of a particular device, it is important to test the device using a potential waveform which closely approximates that of an electrostatic discharge, namely, one which rises rapidly to a peak potential level and then decays exponentially. For testing, an appropriate potential might have a peak potential level of from 100 to 15,000 volts and an exponential-decay time constant of the order of 200 nanoseconds. Such a waveform would be developed across a resistor if the resistor were coupled by means of an "ideal" switch across a capacitor which had previously been charged to the peak potential level. Unfortunately, real switches are less than ideal.

When employed in the above-mentioned circuit, many prior-art-type switches exhibit what is referred to herein as a "preconduction phenomenon," a phenomenon which precedes by a considerable period of time (in nanoseconds) low ohmic contact. When a switch is closed, before low ohmic contact is made, an arc occurs between the contacts transferring a portion of the energy stored in the capacitor. During this time, due to turbulence caused by the arc, an inconsistent energy transfer occurs which is manifest as peaks, valleys and discontinuities in the potential waveform and which is referred to herein as "chatter." (It is important to contrast the use herein of the term "chatter" with the common use of the term in describing an externally or magnetically induced vibration. Also the use herein of the term "arc" differs from its use in describing the arc which may occur when a switch is opened and the contacts separate, particularly when switching an inductive type load.) Generally, preconduction continues until the capacitor potential falls to what is referred to herein as a "threshold potential." After low ohmic contact is made, contacts of many prior-art-type switches "bounce" for many milliseconds. Many prior-art-type switches also exhibit other undesirable characteristics including "high contact resistance," "corona" (an ionization generally around the contacts), "flashover" (a breakdown due to insufficient contact spacing and/or dielectric strength), "contact heat buildup" and "contact deterioration" (oxidation).

Fluids are commonly employed in prior-art-type switches to reduce corona, to cool the contacts, and to damp contact movement to prevent contact bounce. Unfortunately, many such switches suffer from poor contact resistance; and, many such fluids are flammable and/or toxic. Arc induced decomposition is another problem associated with some of the fluids. Further, most of the fluids provide little dielectric strength improvement; and, such improvement is oftentimes at the expense of increased chatter.

Mercury is also commonly employed in prior-art-type switches. One type of mercury-wetted, vacuum relay employs a moving meniscus of mercury to bridge hard alloy contacts when the contacts are closed. The mercury provides bounceless switching with little, or no, preconduction or chatter. Unfortunately, the relay is position sensitive. Also, the mercury is volatile producing mercury vapor which lowers the dielectric strength of the vacuum. Since the mercury vapor partial pressure increases with temperature, the power handling and duty cycle capacilities of the relay are limited.

The reader may find of interest the following United States patents including the patent of F. Clark (U.S. Pat. No. 1,935,595) which discloses a switch having contacts that are immersed in a tank filled with a fluid that includes a fluoride type halogen (see page 2, lines 123–129). Hoover et al (U.S. Pat. No. 2,850,593) discloses a relay having contacts and a solenoid that are immersed in a fluid (see column 1, lines 34–43). The fluid is purported to provide motion damping to reduce mechanically and magnetically induced vibration-type chatter, to provide better electrical resistance between the contacts, to provide suppression of arcs of the type which occur when the contacts are opened and to conduct heat away from the solenoid coil (see column 3, lines 3–11). E. Hardy (U.S. Pat. No. 2,627,504) discloses a switch having a fluid that has a corrosion prevention feature. A reed switch is disclosed by R. Guichard (U.S. Pat. No. 3,818,392); and, a magnetically actuated switch with a heat-conductive, dielectric fluid is disclosed by B. Baker (U.S. Pat. No. 3,067,279). Zahner et al (U.S. Pat. No. 4,020,306); Lloyd et al (U.S. Pat. No. 4,401,871); J. Gratzmuller (U.S. Pat. No. 3,842,227); Wilson et al (U.S. Pat. No. 3,129,277); and, F. Perrotti (U.S. Pat. No. 1,886,153) disclose fluids including fluorine halogens for use with switches.

SUMMARY OF THE INVENTION

Thus, the principal object of the present invention is to provide a means for controlling the flow of very high voltages and currents to allow for instant and total transfer of electrical energy.

Another object of the present invention is to provide a means for mutually exclusively controlling very high voltages and currents through individual paths.

Another object of the present invention is to provide a means for modifying the electrical behavior of conventional electro-magnetic relays whereby the relays may be operated at substantially higher voltages and currents than originally specified.

Still another object of the present invention is to provide a miniaturized arrangement of magnetic switching contacts in a non-conductive fluid and to cause such contacts to open or close under the influence of an external magnetic field.

Briefly the preferred embodiment of the present invention includes a relay having a solenoid and contacts that are immersed in a totally fluorinated hydrocarbon, the relay contacts being gold-plated and wetted with a micro-layer of mercury.

An advantage of the present invention is the ability it affords to provide a switch having a high voltage rate of change during energy transfer.

Another advantage of the present invention is the ability it affords to provide a switch having a high-dielectric-strength, corona-resistive fluid which is stable, inert, non-flammable and non-toxic.

Still another advantage of the present invention is the ability it affords to provide a switch having a fluid which provides significant contact damping and cooling.

These and other objects and advantages of the present invention will no doubt be obvious to those skilled in the art after having read the following detailed description of the preferred embodiments which are illustrated in the several figures of the drawing.

IN THE DRAWING

DESCRIPTION OF THE PREFERRED EMBODIMENTS

For most desirable results, a modified organic fluid is used to protect electrical contacts from destructive arcing at very high voltages and currents. Such a commercially available inert fluid is systematically created by means of a process which basically involves the total replacement of carbon bound hydrogen atoms with fluorine atoms in a purified organic compound.

The method of manufacturing the fluid is electrochemical fluorination. In this process, an organic compound is electrolyzed in liquid hydrogen fluoride. The following reaction, showing electrochemical fluorination of octane, is typical:

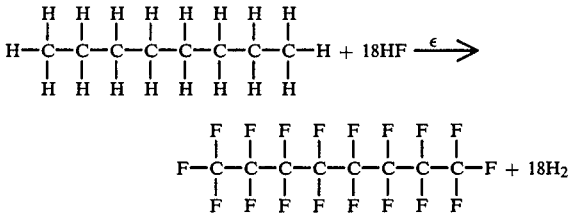

Since fluorination is complete, the products contain no hydrogen or chlorine.

Satisfactory results may be obtained by using other inert fluids or derivatives thereof. The placement of electromechanical contacts in pure silicone will result in improved switching performance and increased contact life.

Inert fluids prevent undesirable side effects that relate to contact deterioration due to arcing in gaseous atmospheres or in vacuum, therefore allowing simple and inexpensive metallic contact structures which are totally immersed in such fluids to be operated at very high voltages and currents.

The viscous properties of most inert fluids is most beneficial in preventing electro-mechanical contacts from bouncing, an undesirable effect not easily controlled in air, vacuum, or in any other gaseous atmosphere.

Inert fluids aid in reducing destructive heating of electromechanical contacts which are totally immersed in such fluids and which are operated at very high voltages and currents. The momentary heating effect of a spark is effectively reduced by the thermal conductivity of the inert fluid.

Electro-mechanical contacts in an inert fluid are totally isolated from air and other gaseous elements, thus preventing unwanted oxidation or other forms of contact degeneration over a prolonged period of time or under high electrical stress.

Figure 1:
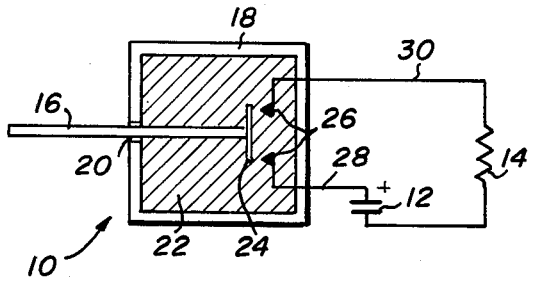
FIG. 1 is a schematic diagram depicting a mechanically operated switch the contacts of which are disposed inside a sealed container filled with a non-conductive fluid.

The fundamental switching circuit (10) in FIG. 1 depicts a typical arrangement of components consisting of a charged capacitor (12) and a load resistor (14). A non-conductive mechanical linkage (16) protrudes through the wall of a container (18) at a location (20) and, in the embodiment, a properly designed seal must be considered to prevent leakage of fluid (22). Linkage (16) is affixed to a conductive bar (24) in close proximity to a pair of contacts (26). Movement of linkage (16) towards electrical shorting across contacts (26) will cause an instantaneous current to flow through a pair of leads (28) and (30) to load resistor (14). It is envisioned that, prior to actual contact, at a very close distance, depending on the voltage, an electrical arc is formed. It is the very nature of the arc that allows an instantaneous current path to be established without appreciable loss of energy and in a very short period of time, typically within a few nanoseconds.

Figure 2:
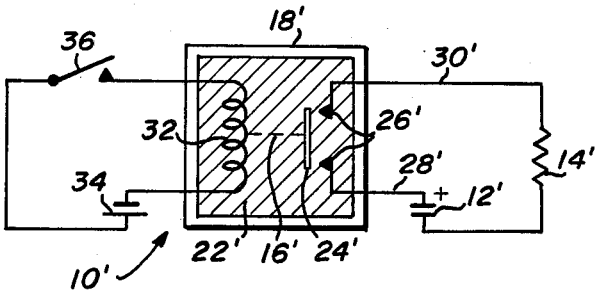
FIG. 2 is a schematic diagram depicting an electromagnetic relay having a solenoid and contacts which are totally immersed in a non-conductive fluid.

The embodiment (10') in FIG. 2 represents an electromagnetic means of engaging linkage (16') attached to conductive bar (24') under the influence of a magnetic field induced by a solenoid (32), which is externally activated by means of an electrical circuit formed by a battery (34) in series with a switch (36). The inert nature of fluid (22') allows placement of solenoid (32), linkage (16'), conductive bar (24'), and contacts (26') in close proximity inside container (18'). The entire arrangement can be expected to operate at high voltage potentials, with little danger of arcing.

In the presently preferred embodiment, a relay of the type which is designated 67RE4-24DC by the Sigma Company is employed. The relay is modified according to the following steps. The plastic dustcover is removed; and, the relay is inspected for quality. The coil dielectric tape and the common pole wire insulation are checked for integrity. The quality of the contact gold plating is verified.

A "fill hole" is drilled in one corner of the top of the dustcover and any chips or particles are cleaned out. The distance between the normally open and normally closed contacts is increased to a dimension determined by the working voltage desired and the dielectric strength of the fluid to be used. Measurements are made to determine that the normally closed contact pressure is sufficient to maintain less than one half ohm contact resistance. The normal operating voltage is applied to the coil; and, the same measurements are made for the normally open contacts. The pull-in and drop-out voltages are measured to assure that they are in the proper range.

The upper portion of the coil frame is wrapped with high dielectric strength tape so that the tape extends 0.050 inches above the frame. Two complete wraps of the tape are made. If necessary, the common pole wires are bent to provide maximum separation from each other, from the coil and from the frame.

The contacts are cleaned by immersing them in alcohol and then blowing them dry with compressed nitrogen or freon gas. A small drop of mercury is applied to each normally open contact face; and, an amalgam is allowed to form. Any excess mercury is removed by tapping the frame on a clean piece of filter paper. (The mercury for this process is protected from air in a small container partially filled with the dielectric fluid to prevent the formation of sulphides on the mercury surface. Any excess fluid clinging to the mercury is removed by placing the mercury on a clean piece of filter paper.) Immediately after the amalgam is determined to be satisfactory, the relay is placed in a test socket and the assembly is immersed in a container of the dielectric fluid. Any bubbles are knocked loose by tapping the relay frame. The relay standoff voltage (20% above rated voltage) is checked in both the open and the closed position. Using a resistor-capacitor discharge test circuit, the waveforms produced at maximum and minimum voltages are checked.

The dustcover is reattached and sealed around the relay base with quick setting epoxy, preferably of the type which is designated Qwik-Set two-part epoxy glue by the Sig Company. The relay case is filled with the fluid and the assembly is placed under at least 15 inches of vacuum for one hour to remove any air trapped in the coil. More fluid is added, if necessary, to remove air bubbles; and, then, the hole is sealed with quick setting epoxy. (A tapped fill hole and threaded plug can be used.)

High voltage insulated wire is soldered to the necessary relay terminals with minimal bare wire exposed. Using 5 or 7 mill mylar strips and quick setting epoxy, a container is made around the relay contacts and solder connections and at least 0.075 inches above any exposed conductor. The container is made by gluing mylar strips of the proper length and width to each side of the relay base and joining the corners with additional epoxy. The container is filled with a proper mixture of two-part epoxy, preferably of the type which is designated Everfix by the Evercoat Company. For printed circuit board applications, the entire assembly is molded into a high dielectric material.

In the presently preferred embodiment, a totally fluorinated hydrocarbon fluid of the type which is generally designated Fluorinert and specifically designated FC-40 by the 3M Company is employed. The properties of the fluid include: Typical Boiling Point 311° F. (in English units), 155° C. (in Metric units); Pour Point −70° F., −57° C.; Density at 25° C. 117 lb/ft$^3$, 1.87 g/cm$^3$; Kinematic Viscosity at 25° C. 2.4 cs, 2.4 cs; Vapor Pressure at 25° C. 0.058 lb/in$^2$, 3 torr; Specific Heat at 25° C. 0.25 Btu/lb-°F., 0.25 g-cal/g-°C.; Heat of Vaporization at Boiling Point 31 Btu/lb, 17 g-cal/g; Thermal Conductivity at 25° C. 0.039 Btu/(hr)(ft$^2$)(°F./ft), 0.00066 watts/(cm$^2$)(°C./cm); Coefficient of Expansion 0.0007 ft$^3$/(ft$^3$)(°F.), 0.0012 cm$^3$/(cm$^3$)(°C.); Surface Tension at 25° C. 0.0029 pounds/in, 16 dynes/cm; Refractive Index at 25° C. 1.290, 1.290; Dielectric Strength at 25° C. 46 KV (0.10 in gap), 46 KV (2.54 mm gap); Dielectric Constant at 25° C. (1 KHz) 1.89, 1.89; Dissipation Factor at 25° C. (1 KHz) 0.0003, 0.0003; Volume Resistivity at 25° C. $4.0\times10^{15}$ ohm-cm, $4.0\times10^{15}$ ohm-cm; Solubility of Water 7 ppm(wt.), 7 ppm (wt.); Solubility of Air 27 in$^3$gas/100 in$^3$ liquid, 27 ml gas/100 ml liquid; and Average Molecular Weight 650, 650.

The fluid provides a high dielectric strength and a high corona resistance and, yet, is inert, non-flammable, and non-toxic. Further, the fluid is stable, not being decomposed by the arc. The arc momentarily vaporizes the fluid at the contact surface creating a turbulent interface which removes heat from the contacts.

The gold and micro-layer of mercury form an amalgam which strongly adheres to the contact structure while maintaining a self-repairing liquid interface for actual contact. The volatile nature of the mercury is subdued by the atmospheric pressure in conjunction with the high molecular weight of the fluid. The mercury eliminates the contact bounce which is substantially reduced by the viscosity of the fluid. The mercury-fluid combination also eliminates the chatter exhibited by the fluid alone at low voltage. Further, the combination reduces to approximately 10 to 15 volts the approximate 300 volt threshold voltage exhibited by the fluid alone.

Figure 3:
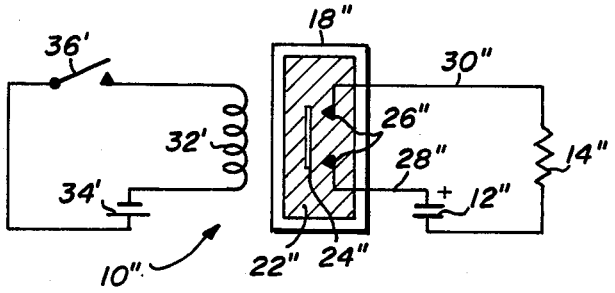
FIG. 3 is a schematic diagram depicting an electromagnetic relay of which only the contacts are immersed in a non-conductive fluid.

The embodiment (10'') in FIG. 3 is preferred when further reduction in size is important, by externally locating activation coil (32') and only immersing conductive element (24'') and contacts (26'') in an inert fluid. Conductive bar (26'') is suitably contracted out of magnetic material and is operated under the influence of a magnetic field generated by coil (32') in conjunction with battery (34') and switch (36'). As in the case in FIG. 2, substantial voltages and currents can be switched in a relatively small space.

Figure 4:
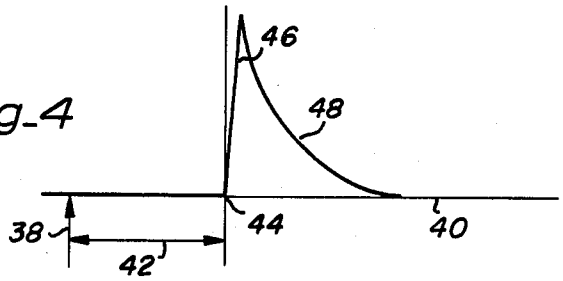
FIG. 4 depicts a typical response waveform associated with the circuits shown in FIGS. 1 through 3.

FIG. 4 represents a typical and unique response waveform as noted across load resistors (14) in FIGS. 1–3. From the moment of activation, denoted by a time (38) along a time axis (40), a fixed period (42) elapses before switching occurs at a time (44). Conduction occurs when the physical separation between contact surfaces is reduced to cause the inert fluid to break down at the rated voltage potential, followed by a transition (46), terminating in an exponential decay (48). It should further be appreciated that no significant preconduction exists prior to time (44), and that the rate of change depicted by slope (46) is significantly faster than any known mechanical switching device. Exponential decay (48) is uninterrupted by contact bounce.

It is contemplated that after having read the preceding disclosure certain alterations and modifications of the present invention will no doubt become apparent to those skilled in the art. It is therefore intended that the following claims be interpreted to cover all such alterations and modifications as fall within the true spirit and scope of the invention.

What is claimed is:

1. A method of improving the switching performance of a pair of switch contacts, the method comprising in combination the steps of at least partially enclosing the pair of contacts and filling the enclosure at least to the point where the pair of contacts are immersed in a solution at least a portion of which comprises: a totally fluorinated hydrocarbon having an average molecular weight of 650.

2. A method of improving the switching performance of a pair of switch contacts as recited in claim 1 wherein said totally fluorinated hydrocarbon is of the type which is designated FC-40 by the 3M Company.

3. A method of improving the switching performance of a pair of switch contacts as recited in claim 1 further comprising the step of developing a gold-mercury amalgam on at least one of said pair of switch contacts.

4. A method of improving the switching performance of a pair of switch contacts as recited in claim 3 wherein said totally fluorinated hydrocarbon is of the type which is commonly designated FC-40 by the 3M Company.

5. A switch comprising:

a quantity of fluid at least a portion of which is a totally fluorinated hydrocarbon having an average molecular weight of 650; and at least one pair of contacts immersed in said fluid.

6. A switch as recited in claim 5 wherein said fluid is of the type which is designated FC-40 by the 3M Company.

7. A switch as recited in claim 5 wherein each of said pair of contacts has a gold-mercury amalgam developed thereon.

8. A switch as recited in claim 7 wherein said fluid is of the type which is designated FC-40 by the 3M Company.

9. A switch as recited in claim 5 wherein said pair of contacts have a first state in which said contacts are closed to make electrical contact therebetween and a second state in which said contacts are opened and wherein the switch further comprises solenoid means for selectively causing said pair of contacts to change from one of said states to the other one of said states.

10. A method of improving the switching performance of a pair of switch contacts as recited in claim 1 wherein at least one of said pair of switch contacts is of a noble metal, the method further comprising the step of developing a mercury amalgam on said one of said pair of switch contacts.

* * * * *